United States Patent [19]

Dalbanne

[11] 4,443,982

[45] Apr. 24, 1984

[54] METHOD AND DEVICE FOR SWIMMING POOL CONSTRUCTION

[76] Inventor: Jacques Dalbanne, 6, Rue du Lac, 06400 Cannes, France

[21] Appl. No.: 394,771

[22] Filed: Jul. 2, 1982

[30] Foreign Application Priority Data

Jul. 10, 1981 [FR] France ..... 81 13673

[51] Int. Cl.[3] ..... E02D 27/34

[52] U.S. Cl. ..... 52/169.7; 52/247; 52/742

[58] Field of Search ..... 52/169.7, 247, 403, 52/742, 586

[56] References Cited

U.S. PATENT DOCUMENTS

| | | | |
|---|---|---|---|
| 3,094,709 | 6/1963 | Miccio et al. | 4/172 |
| 3,317,927 | 5/1967 | Shields | 52/247 X |
| 3,363,383 | 1/1968 | La Barge | 52/403 X |
| 3,468,088 | 9/1969 | Miller | 52/169.7 |
| 3,745,593 | 7/1973 | Wall | 4/172.19 |
| 3,812,633 | 5/1974 | Shanni et al. | 52/169 |
| 3,885,364 | 5/1975 | Lankheet | 52/169 |
| 3,906,688 | 9/1975 | Witte | 52/152 |
| 4,090,266 | 5/1978 | Prize | 52/169.7 |

FOREIGN PATENT DOCUMENTS

| | | |
|---|---|---|
| 2190142 | 1/1974 | France . |
| 848650 | 9/1960 | United Kingdom . |

*Primary Examiner*—Carl D. Friedman

*Attorney, Agent, or Firm*—Owen, Wickersham & Erickson

[57] ABSTRACT

Structure for the construction of swimming pools, characterized in that it consists of: rigid vertical sections (3) each comprising at least one outer face (5) and one inner face (8) provided with an opening (7), at least one relatively flexible base band (1) comprising at regular intervals means of securing the said outer faces (5) in such a way that only small spaces remain between these successive faces (5), assembly sections (4) or keys which are relatively deformable transversally and capable of fitting on the lateral ends (9) of the said inner faces (8) to fix together and fill in the varying space between these ends of two successive sections (3).

6 Claims, 2 Drawing Figures

METHOD AND DEVICE FOR SWIMMING POOL CONSTRUCTION

The invention relates in particular to the construction of swimming pools, particularly on private premises.

In order to construct a swimming pool there exist a range of methods, notably the conventional method with a concrete form which requires relatively substantial formwork to be built, particularly if the pool has curved sections, which also needs additional earthworks for postioning the formwork and which requires different internal finishes depending on the covering used. This therefore involves a long and costly process. Another much more rough and ready method consists in using precast panels and sealing by means of a flexible inner liner. In this case the shape in plan is limited to polygonal outlines and the flexible lining is very much exposed and needs changing in the case of accident.

The aim of the invention is to eliminate the above drawbacks by making it possible to quickly build a very rugged swimming pool which is, however, moderate in cost and also allows for great freedom in its shape.

The invention consists in combining rigid vertical sections with bands which are flexible enough to follow the required curves, in particular with a base band onto which the sections are fixed at regular intervals, with the space between two successive vertical sections, which varies with the local curvature, preferably being filled by vertical insertion of a filler section which fits onto the two vertical sections and which has a flexible enough cross-section to match the space assigned to it. In addition to means for securing the main sections the base band also comprises means for securing the vertical arm of L-shaped concrete reinforcing bars, the horizontal arm of which is designed to join up with the swimming pool bottom raft reinforcement, and the main vertical sections have a groove in the back which fits onto the said section. A set of perforations allows for various fixings and the concrete is poured into the sections and sprayed onto their inside surface, which may be provided with mesh.

Other features of the invention will be revealed in the following description of an embodiment taken as an example and shown in the appended drawings, in which.

Figure 1:
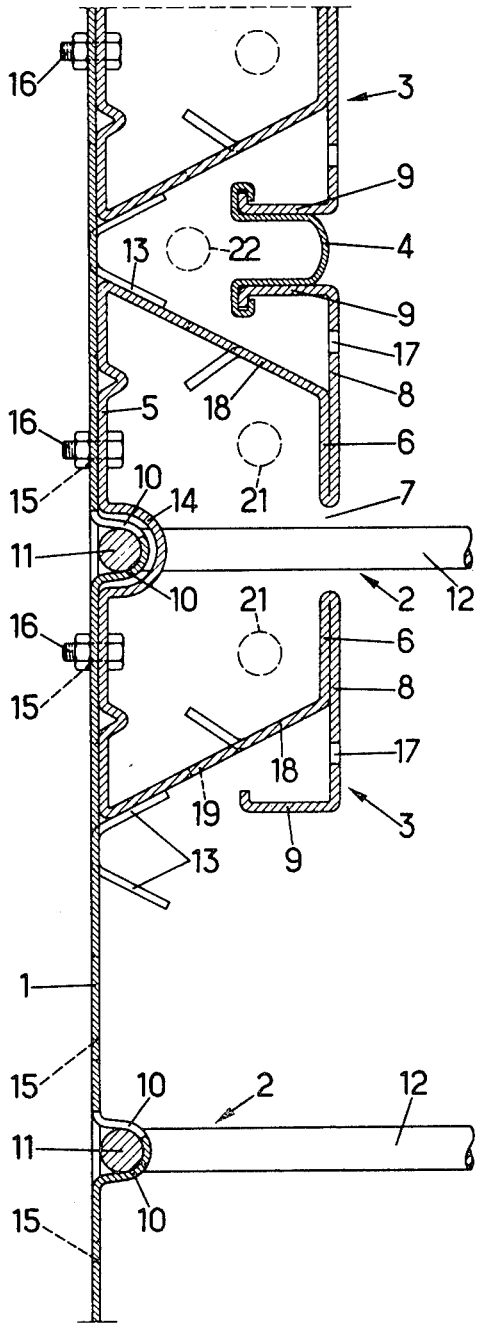
FIG. 1 is a horizontal section along I—I of FIG. 2.

In the figures can be seen the main elements enabling the invention to be applied, i.e. the base band 1, the bent-up reinforcing rods 2, the vertical sections 3 and their joint key 4. The vertical sections 3, which are relatively rigid and preferably made of bent sheet, have a roughly trapezoidal cross-section with the long base 5 facing out; the short base 6 comprises a central opening 7 along with a potion bent back to form a widened face 8, on either side of this opening 7, located on the inner side of the swimming pool, with return flanges 9 bent twice through 90°.

The base band 1, which is relatively more flexible, consists of a band of strip metal in which double tabs 10 are punched and pressed at regular intervals so that the vertical arm 11 of a section of reinforcement bar bent at right angles and forming the bent-up bars 2 can be positioned, with the corresponding horizontal arm 12 being located at the bottom. This strip also comprises triangular tabs 13 at regular intervals having a spacing and folding angle corresponding exactly to the angles at the base of the trapezoidal cross-section of sections 3, so mating with the bottom end of the latter as shown in the figures. In order to enable these sections to be fitted the back 5 of the sections 3 comprises a central groove 14 fitting over the assembly of the vertical arm 11 with the double tabs 10. In order to complete this fixing the strip 1 contains oblong perforations 15, on either side of the position of each vertical arm 11, and the back 5 of each section has series of oblong perforations with the same spacing providing for fixing to the strip by means of bolts like 16. Each of the inner faces 8 also preferably comprises a series of other oblong perforations 17 making it possible to fix a mesh along the internal face of the swimming pool if required and the sloping faces 18 of the trapezoidal cross-section of each section 3 also preferably comprise perforations or slits 19 allowing the concrete to flow through.

Finally, joint sections 4 or "keys" in more flexible metal, and roughly U-shaped, are provided, possibly having further corrugations to increase flexibility, and with the two edges shaped as shown in FIG. 1 to fit over the returns 9 of the flanges 8.

In order to construct a swimming pool by means of the method according to the invention the beginning is naturally the earthworks needed to create the necessary excavation, the bottom of which is covered with a bed of blinding concrete and then receives the raft reinforcing lattice 20 covering the whole area of the bottom.

To form the side walls one begins by placing the base band, formed by successive lengths of strip 1 connected together, along the chosen profile; this strip's flexibility allows it to follow all the convex or concave curves the pool may involve as well as, naturally, the straight parts, if there are any.

Figure 2:
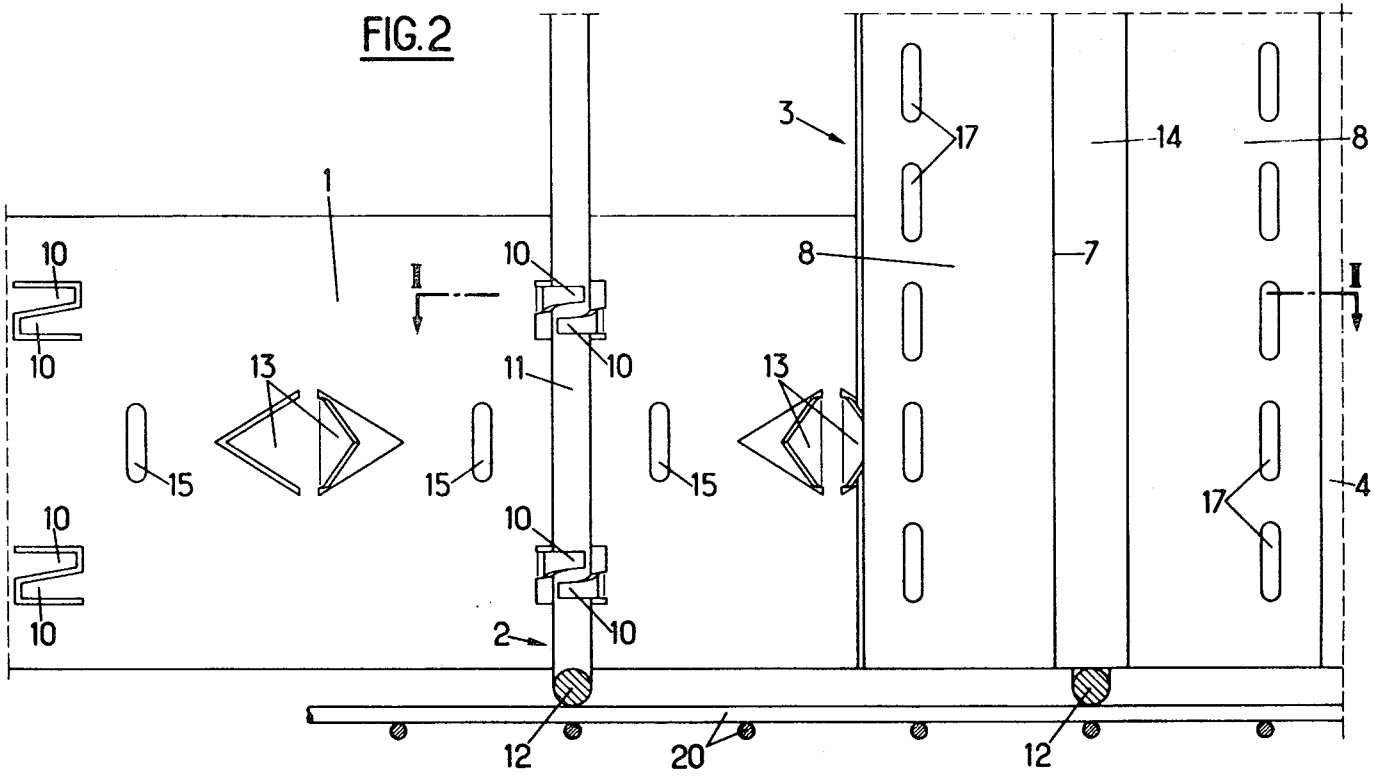
FIG. 2 is a part elevation view of the base of the system.

Before installing each section of strip 1, care is taken to insert into the double tabs 10 the bent-up bars 2, whose vertical arms 11 are simply threaded into the corresponding passages or, as a variant, inserted laterally, the tabs 10 being left open and then hammered back over these arms. It can be seen in particular in FIG. 2 that the horizontal arms 12 of these bent-up bars 2 come and join up with the raft lattice 20.

The various vertical sections, cut to the required length corresponding to the depth of the pool, are then each inserted between the tabs 13 in a predetermined position, and fixed by means of bolts 16. Higher up one or several other similar bands can be placed, but it is also possible to use one or more bands consisting of a simple perforated, or even unperforated strip, supporting it by hooks of steel wire hooking into the perforations of the back 5 of the sections.

In accordance with the invention the deformable keys 4 are then inserted vertically from the top and forced into place, by driving. Thus the pitch of the section backs 5 is determined by the band 1 placed on the outside, so that, depending on whether the plan profile is concave or convex, and depending on the curvature of this profile, the intervals between the return flanges 9 of two successive sections varies so that it is wider or narrower with respect to the mean position corresponding to a straight profile. Each of the keys 4 must therefore open laterally slightly, or close up to fit the space remaining. Once they have been installed these keys provide a good join or tie holding the various sections 3 together.

Thanks to the invention it is not at all necessary to make any formwork or shuttering, either on the outside or on the inside. The most that may be needed is to place shores or struts, not shown in the drawings, at intervals, fixing them into the perforations of the section backs to hold the whole installation in a truly vertical position. If necessary the reinforcement can be supplemented by adding extra bars 21 or 22 inside the sections 3 or between them.

After having gradually installed all the elements in place as set out above and after placing the raft concrete, all the space contained inside the sections 3, as well as between these sections in the area of the keys 4, is filled with concrete, by pouring or by spraying, since these two spaces are connected by the slits 19. The small space remaining between the base angles of any two successive sections 3 does not allow the concrete to flow outside. The same is true of the passage 7 on the inside and also of the perforations 17.

This concrete may, as wished, be poured from the top or sprayed by cement gun from the inside face of the swimming pool using the openings 7 for this purpose.

As a refinement it is even possible to fix beforehand, using the perforations 17, a continuous mesh on the inside face of the swimming pool; this mesh nevertheless allows concrete to be sprayed through the openings 7 and makes a perfect key for this concrete whilst forming an additional horizontal tie system.

Naturally the sprayed concrete may, as wished be hawked or smoothed depending on the covering it is required to apply subsequently on the inside face of the swimming pool after a water repellent rendering has been applied. This covering may, in particular, consist of stoneware tiling or pate de verre mosaic, a flexible liner like vinyl chloride coated canvas, or again a sprayed epoxy resin or waterproof paint.

The top edge of the swimming pool is finished in the usual way and all the finishes or water drainage channels may be fixed on the top of the vertical sections 3 by using, if need be, the perforations of the backs 5 of the sections 3, again.

The invention thus allows for great versatility in producing the widest range of shapes and makes for very speedy execution owing to the lack of formwork and therefore of the need to strike shuttering; the cost of the whole installation is cut down proportionately and naturally varies according to the type of internal covering chosen.

I claim:

1. A structure for the construction of swimming pools, comprising:

a plurality of rigid vertical sections each having at least one outer face and one inner face provided with an opening, and with lateral ends, at least one relatively flexible base band having at regular intervals means for securing said outer faces in such a way that only a small space remains between successive outer faces, a plurality of keys which are relatively deformable transversely and are capable of fitting onto the lateral ends of said inner faces to fix together and fill in the varying interval between the ends of two successive sections.

2. The structure according to claim 1, having a reinforcing lattice and bent-up reinforcement bars bent at right angles with a vertical arm fixed onto said base band on the centre line of each section said fixing being done by attachment means, and a horizontal arm joined to said reinforcing lattice.

3. The structure according to claim 2 wherein each of the vertical sections has a roughly trapezoidal shape with a long base facing outwards and provided in the centre with a groove for said vertical arm of a said reinforcing bar and a said attachment means to pass through, each said section having lateral faces provided with perforations for concrete to flow through, said inner faces being continued laterally on each side of a central opening to said lateral ends which provide return flanges, where the keys are fitted.

4. The structure according to claim 3, wherein said strip comprises, at regular intervals, said attachment means for the vertical arms of the bent-up reinforcement bars, and triangular tabs whose spacing and slope fits with the angles at the base of said trapezoidal cross-section of the vertical sections, securing means, and oblong perforations working in conjunction with corresponding perforations in the back of the sections to receive said securing means.

5. The structure according to claim 4, wherein each said inner face comprises, in addition, perforations for securing a continuous mesh on the inner face of the swimming pool.

6. A method of constructing a swimming pool comprising:

making an excavation, placing a suitably clean concrete bed on the bottom of the excavation, laying a raft reinforcement on said concrete bed, placing thereon a base band fitted with bent-up bars having horizontal arms, affixing a series of vertical sections having spaced-apart inner and outer faces, while supporting said sections higher up by other bands and by shores, then inserting successive keys into position for joining said sections together, providing any needed extra reinforcement, attaching a continuous mesh on the inner face, pouring raft concrete to surround the horizontal arms of the bent-up bars, then filling with concrete all the space contained between the inner and outer faces of the sections and the spaces in between adjacent sections, and then finishing the lining of the swimming pool.

* * * * *